United States Patent [19]

McMickle, Jr.

[11] 4,096,683

[45] Jun. 27, 1978

[54] AMPOULE FILLING AND SEALING MACHINE

[75] Inventor: John F. McMickle, Jr., Piscataway, N.J.

[73] Assignee: Cozzoli Machine Company, Plainfield, N.J.

[21] Appl. No.: 769,188

[22] Filed: Feb. 16, 1977

[51] Int. Cl.[2] ..... B65B 5/10; B65B 23/22; B65B 3/00

[52] U.S. Cl. ..... 53/244; 53/266 B; 53/285; 65/109; 65/270; 65/280; 141/49; 198/453

[58] Field of Search ..... 53/37, 39, 112 R, 244, 53/266, 285; 65/270, 271, 272, 280, 285, 108, 109; 141/49, 101, 137; 198/373, 384, 410, 453, 455

[56] References Cited

U.S. PATENT DOCUMENTS

| | | | |
|---|---|---|---|
| 2,379,343 | 6/1945 | Cozzoli | 65/271 |
| 2,633,672 | 4/1953 | Ralston | 65/280 |
| 2,749,688 | 6/1956 | Cozzoli | 53/266 |
| 3,652,249 | 3/1972 | White | 65/109 |

*Primary Examiner*—Robert Louis Spruill
*Attorney, Agent, or Firm*—Kirschstein, Kirschstein, Ottinger & Cobrin

[57] ABSTRACT

An ampoule filling and sealing machine with feeding, filling, sealing and loading stations. A horizontally oriented endless chain drive moves the ampoules through the filling and sealing stations. Belts or a reciprocating agitator are provided in the feeding station. A plurality of spring-loaded movable rails and a final stationary rail guide the line of ampoules in the filling station. The filled ampoules in the sealing station are spun by rotating pinions of cylindrical rollers on the endless chain drive in cooperation with inclined discs. In the loading station a channel receives a line of sealed ampoules. One side of the middle portion of the channel is a horizontal flat spring backed up by a spring-loaded bar. A fixed stop is spaced from the backing bar. A spring-loaded gate is at the inlet to each loading tray.

30 Claims, 16 Drawing Figures

FIG. 7
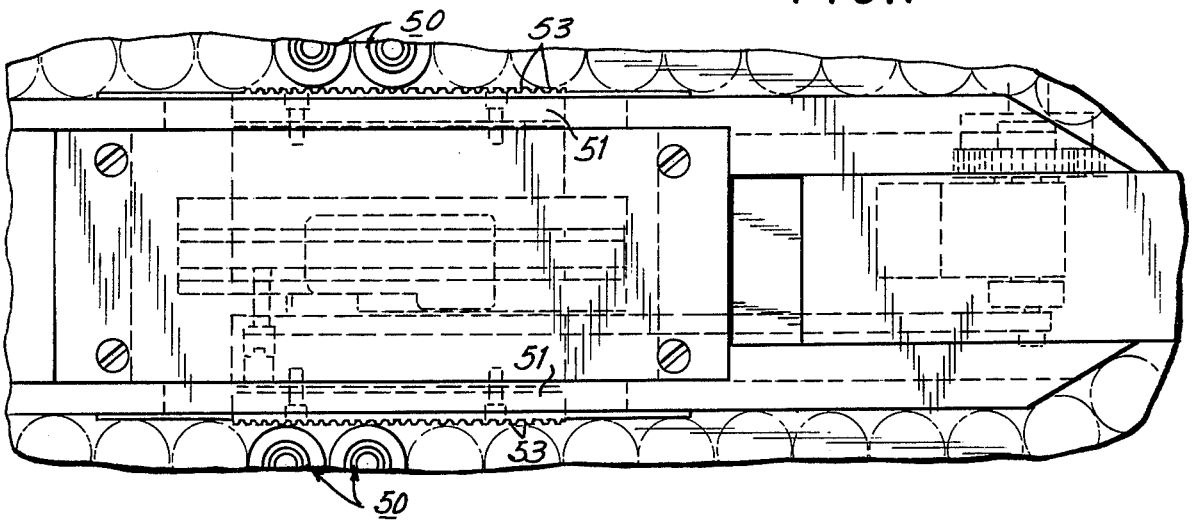
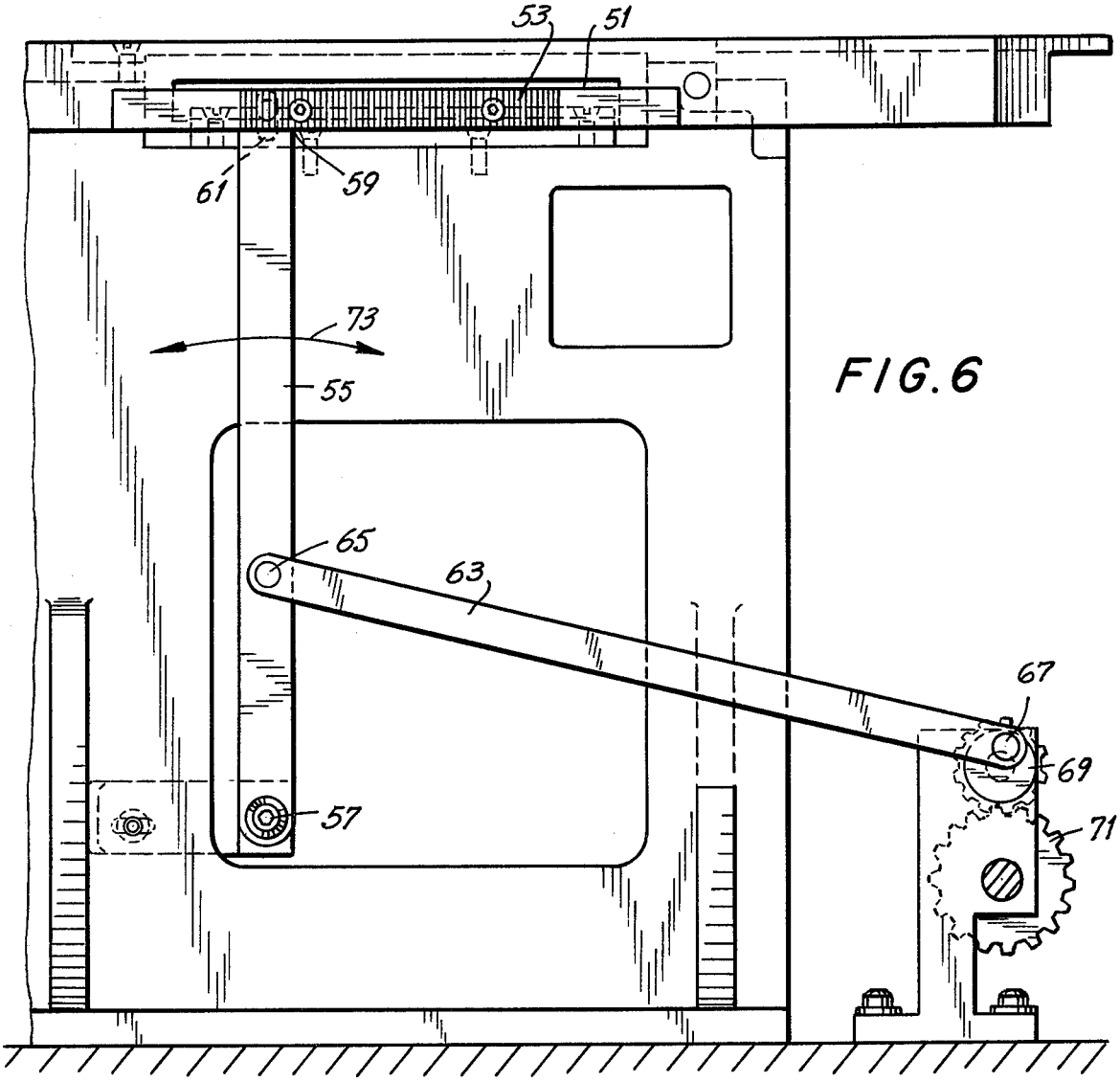
FIG. 6

AMPOULE FILLING AND SEALING MACHINE

BACKGROUND OF THE INVENTION

1. FIELD OF THE INVENTION

The invention relates to a machine for the continuous production of filled and sealed ampoules.

2. DESCRIPTION OF THE PRIOR ART

Many liquid medicaments are injected into the human body by hypodermic needles on syringes. The syringes usually are filled from glass ampoules which previously have been loaded with the medicament at a pharmaceutical plant. The particular medicament generally is prepared in bulk and a large number of individual ampoules is filled in a given run or batch by passing empty ampoules through a machine in which ampoules are intermittently individually filled with measured amounts of liquid medicament and sealed by playing a flame around the middles of the necks of the ampoules, generally above a ceramic bead or ring disposed around the base of the neck of each ampoule. Concomitantly, gripper fingers, or the like, lift the cooler upper neck upwardly and away from the body of the ampoule, and the molten glass remaining at the lower neck of the ampoule coalesces to provide a positive seal against contamination, evaporation or spillage. When the filled ampoule is to be used, the remaining neck portion is snapped off at the ceramic bead or ring, and the point of a hypodermic needle is inserted into the medicament in the ampoule. Liquid is aspirated into the syringe by drawing the plunger of the syringe away from the ampoule. Thereafter, the needle point is inserted into a patient's body and manual reverse movement of the plunger toward the needle point forces the medicament into the human body.

In addition to parenteral subdermal injection of medicinal liquids into humans, ampoules are also used in the veterinary field.

The art of machine design for the filling and sealing of ampoules entails the provision of equipment for installation in pharmaceutical plants to rapidly fill and seal large quantities of ampoules with accurately measured amounts of liquid, without excessive breakage or jamming. A relatively complex machine technology has evolved, and improvements in the art entail the provision of apparatus which will fill the ampoules and seal them at faster and faster rates. Most technology entails the use of four separate successive stations for each machine, namely, empty-ampoule feeding, filling, sealing and loading stations. Prior art apparatus, dealing with typical ampoule sizes of ½ cubic centimeter to 20 cubic centimeters, had a throughput of typically about 100 ampoules per minute on single line filling and sealing. Often the empty ampoules were manually placed in inclined infeed chutes, with a single chain, two rollers, tabs top and bottom, and a stationary rail. The empty ampoules were sometimes fed in a batch, being led to a single file procession to the chain. When down to two abreast, the ampoules often bridged or jammed. Breaking the ampoule bridges or jams in the feeder customarily entailed the use of either an air vibrator or an electric vibrator. An air vibrator was objectionable because of the presence of non-sterile air, and both types of vibrators usually were noisy and subject to breakdown. A circular tray feeder or rotating table with a star valve was frequently employed, with a flying fill and a flying seal. During the handling of the ampoules in the machine, an intermittent Geneva drive sometimes was utilized, this being inherently slow. In many prior art installations, the machines had to be stopped periodically for loading and unloading of ampoules.

Among the many prior art patents relating to ampoule filling and sealing machines may be mentioned U.S. Pat. Nos. 3,205,920; 2,827,997; 2,749,688; 2,704,147; 2,680,331; 2,530,230; 2,500,521; 2,379,343 and 2,258,408.

SUMMARY OF THE INVENTION

1. Purposes of the Invention

It is an object of the present invention to provide an improved machine for the filling and sealing of ampoules.

Another object is to provide such a machine which has a higher output than heretofore.

A further object is to provide such a machine which eliminates operators and may be run by only one person, thereby lowering labor costs.

An additional object is to provide such a machine which is relatively small and compact and which, therefore, conserves expensive space in the clean room, i.e. in the sterile environment, where the ampoules are filled.

Still another object is to provide such a machine which is capable of operating continuously, i.e. a machine which runs continuously and does not have to be stopped periodically for the loading and unloading of ampoules.

Still a further object is to provide such a machine in which there is continuous movement of the ampoules through the machine without stop-and-start operations at any station and without surges, pile-ups or jamming.

These and other objects and advantages of the present invention will become evident from the description which follows.

2. Brief Description of the Invention

In the present invention, there are several salient aspects of novelty, and improvements at all of the stations, namely, the empty-ampoule feeding station, the filling station, the sealing station and the loading station. These improvements, taken in combination, result in the attainment of the objects of the invention, i.e. a machine with a higher output rate of filled and sealed ampoules.

At the outset, the machine will be described with regard to the provision of a single line of ampoules, and machine elements and appurtenances to handle this single line of ampoules; however, in practice, two parallel lines of ampoules usually are provided, with mirror image elements on opposite sides of a central line through the machine.

An important improvement in the present machine is in the apparatus for moving a line of ampoules continuously through both the filling station and the sealing station. To this end, a single horizontally oriented endless chain drive is provided which is trained about two horizontally opposed and vertically oriented circular wheels provided with sprockets, which wheels are rotated by a suitable drive, e.g. an electric motor connected to the wheels by belting and pulleys or by direct shafting. A plurality of equidistantly spaced and identical vertical cylindrical rollers is externally mounted on the chain drive in a manner such that each of the rollers is free to rotate about a central axis, with the central axis of each of the rollers being perpendicular to the direction of movement of the chain drive. Each of the rollers will typically and preferably be provided with a pinion to enable the rollers to be individually rotated, and thus the ampoules are individually rotated as the chain drive moves through the sealing station and adjacent to a fixed toothed rack at the sealing station. The rack engages the pinion on each roller so that each ampoule is rotated as the line of ampoules moves through the sealing station, and thus a uniform seal is attained. The fixed rack preferably is preceded by a juxtaposed floating toothed rack, i.e. a rack which is flexibly spring mounted, so that the pinion of each roller is properly aligned with the teeth of the fixed rack as the roller proceeds to the sealing station, and thereby inadvertent stripping of gears due to misalignment is effectively prevented.

The novel empty-ampoule feeding station is characterized by two horizontal belts or a horizontal belt and vertical agitator for feeding, rather than the rotating table of the prior art. The feeding station includes an inclined tray to receive a batch of empty ampoules; the empty ampoules, as furnished, are crated, neck up, and the operator merely inverts the crate so that a batch of upright (bottom down) empty ampoules is placed in the inclined tray. The empty ampoules are gravitationally urged downwardly toward the lower edge of the tray. A first horizontal belt having a horizontally oriented surface is provided below the lower edge of the tray. A second horizontal belt or agitator having a vertically oriented surface is provided above the first horizontal belt. Suitable drive means moves the first and second belts horizontally toward the filling station so that, as empty ampoules move into the filling station, further empty ampoules move downwardly on the inclined tray and onto the first horizontal belt and are, in turn, moved toward the filling station of the machine by both of the horizontal belts, or by the first belt and agitator.

The second horizontal belt, i.e. the belt with a vertically oriented surface, preferably moves at a linear speed which is greater than the linear speed of the first belt; the linear speed of the second belt will typically be about twice the linear speed of the first belt. The first belt desirably is composed of a metal flexible strip such as a thin strip of stainless steel, and the second belt is preferably composed of a non-metallic material, e.g. rubber. The second belt will usally be slightly inclined downwardly toward the filling station in order to urge the empty ampoules downwardly against the first belt and thus properly to align the empty ampoules as they progress toward the filling station. As an alternative to the second belt, the agitator may be provided, which agitator is typically composed of plastic and has straight vertical serrations which reciprocate against the ampoule sides causing jams to dislodge.

The ampoule filling station is provided with a walking beam purger-filler which sequentially carries out three functions. In a first step, the purger-filler flushes and purges air from the empty ampoules to attain maximum sterility and to prevent possible oxidation of components of the liquid fill during storage of the filled and sealed ampoules prior to usage. An inert gas, e.g. nitrogen, is used to purge air from the empty ampoules. The machine is designed so that it may also be used without flushing. The second step in the sequence is to fill the empty and nitrogen-filled ampoules with a controlled and measured amount of liquid fill, e.g. a liquid medicament. Thirdly, the head spaces of the filled ampoules again are purged with nitrogen, or the like, prior to sealing of the ampoules, since the filling step may introduce small amounts of air into the necks of the ampoules. This third step is also optional, i.e. the machine may be used without post-flushing.

A line of empty ampoules is moved below the walking beam purger-filler at a constant and controlled speed by suitable means, e.g. by the rollers mounted on the endless chain drive as described supra.

A novel aspect of the invention is that each of the rollers which are disposed between and engage two adjacent but spaced ampoules cooperates with a line of rails on the opposite side of the line of ampoules, so that the line of ampoules is properly oriented during filling. Since two parallel lines of ampoules are contemplated, with a central endless chain drive and two parallel lines of cylindrical rollers the line of rails will, in practice, in this specific configuration of the machine, be disposed on the outer side of the line of ampoules, relative to the central chain drive. The line of rails constitutes a plurality of aligned rails on one side of the line of ampoules, with each of the rails being movably spring-loaded except for the final rail which is stationary so that the line of ampoules is precisely introduced into the sealing station.

The ampoule sealing station includes burner means cooperating with gripper finger means that lift the upper neck of each ampoule upwardly and away from the portion of the neck where the burner means has sealed the neck by melting and coalescing this glass neck portion and also cooperating with means to rotate the filled ampoules during burner-sealing so that a uniform separation and coalescence of the neck portion is attained. The means to rotate the filled ampoules presents a further novel aspect of the invention. This means preferably is the geared and rotating rollers on the endless chain drive cooperating with a line of spaced inclined discs on one side of, and in contact with, a line of filled ampoules. As mentioned above with regard to the orientation of the line of rails, in a preferred embodiment the line of inclined discs will be oriented on the outer side of each line of the two parallel lines of filled ampoules when a centralized endless chain drive having two parallel lines of cylindrical rollers is provided. Each of these inclined discs has a resilient outer edge and is inclined against the motion of the filled ampoules, so that the filled ampoules are urged downwardly to a precise position during burner-sealing, thereby insuring uniform and accurately dimensioned product ampoules, as well as insuring that the gripper finger means will grasp the burned off portion of the neck of each ampoule rather than the entire ampoule.

The resilient frictional peripheries of the inclined discs may be composed of any suitable resilient material having a high coefficient of friction such as natural or synthetic rubber, e.g. neoprene. The angle of incline from the horizontal of the discs will typically be about 5 degrees.

With regard to the burner means, in contrast to the prior art in which the gas burners emit a flame which generally is perpendicular to a vertical plane through the central axes of the line of ampoules, in the present invention a new disposition of burner means has been employed. The burner means constitutes a plurality of juxtaposed, individual, generally horizontal gas burners that burn a gas, e.g. natural gas principally containing methane, with commercially pure oxygen rather than air, so that a higher flame temperature and greater concentrated heat output is attained. The individual gas burners are aligned in parallel at an acute angle to the direction of travel of the ampoules, so that a flame is emitted from each gas burner with a component of motion in the direction of travel of the ampoules, i.e. the flame is angular rather than directly perpendicular to a vertical plane through the central axes of the line of ampoules. This anular disposition of the flame has been found to provide a more uniform burner-sealing, because adjacent gas burner flames tend to blend into each other to provide a uniform line of heating rather than staggered individual flames.

In a preferred embodiment as mentioned supra, the ampoules travel in two parallel lines and a central endless chain drive having two parallel lines of mounted cylindrical rollers is provided. In this case, two parallel outer burner means are provided, and a novel apparatus is provided so that a central axial air curtain is generated which prevents the heat from the burner means on one side of the machine from affecting the ampoules on the opposite side of the machine. This novel apparatus is a central linear air curtain manifold between the two parallel lines of ampoules. The manifold has a central line of spaced apart top openings or a central slot along the length of the manifold, and suitable means such as an air blower or pump is provided to pass air into the manifold, so that the air is emitted from the top outlet openings or from the slot and a linear vertical air curtain is provided between the two parallel lines of ampoules.

The air outlet openings in the air manifold are typically drilled holes in a horizontal rectangular parallelepiped metal hollow block manifold, and the parallel drilled holes are preferably inclined at an acute angle from vertical, so that the linear air curtain is emitted generally vertically but with a component of motion in the direction of travel of the ampoules, for reasons comparable to the considerations developed above with regard to the angular nature of the flames emitted from the gas burners. This acute angle will typically be about 30° from the vertical.

Novel aspects and features have been developed with regard to a filled-ampoule loading station of the ampoule filling and sealing machine, so that the loading station can accommodate for surges, e.g. when a loaded tray full of product ampoules is shifted away from the ampoules outlet of the machine and replaced by an empty tray. The loading station includes a channel to receive a line of sealed ampoules from the sealing station. One side of the middle portion of the channel is provided with and defined by a horizontal spring. A spring-loaded backing bar is disposed behind the horizontal spring, so that a surge of ampoules will deform the horizontal spring outwardly against the backing bar, which bar, in turn, since it is spring-loaded, will temporarily displace outwardly so that the surge of ampoules is accommodated by displacement of the backing bar.

After the surge is dissipated, the spring-loaded backing bar will return the horizontal spring to its normal linear state defining one side of the channel. Stop means is spaced from the backing bar and mounted on a fixed support to restrain the backing bar against excessive displacement and to limit the surge accommodation, so that a continuing force is exerted from ampoule to ampoule in the surge tending to end the surge.

At least two horizontal discharge trays are disposed at the outlet of the channel, together with suitable means to alternately shift the trays so that a tray loaded with product-filled and sealed ampoules may be shifted and removed from the channel outlet and manually replaced with an empty tray while the other tray of the pair of trays is being filled. The outlet of the channel extends alternately to an inlet to one or the other of the trays; a spring-loaded gate is provided at the inlet to each tray to control ampoule movement onto the tray, and ampoule disposition and stacking on each tray is controlled by the provision of a movable linear bar on each tray, with each movable linear bar generally being perpendicular to the channel, so that as the ampoules progress onto a tray, the movable bar moves away from the tray inlet under the influence of the force and pressure exerted by the ampoules, whereby the filled ampoules are held in a stacked upright position by the bar.

Finally, the usual loading tray appurtenances such as an electric eye to monitor the tray and signal when it is full of ampoules, automatic tray switching means to switch the tray positions so that the continuous sealed ampoules feed passes from the channel outlet to an empty try when the other tray is full, tray support means, etc., will be provided in practice.

As will appear below, the overall operation of the machine is controlled by a push-button and switch array mounted in a control box; the usual motive power means such as electric motors, belt and pulley drives, chain and sprocket wheel drives, direct shafting, a mounting framework of angle iron, etc., are provided, as well as adjustment means to accurately position or adjust the relative positions of the various elements of the machine, so as to assure smooth trouble-free sustained operation of the machine which may be continuous and extend indefinitely on a 24-hour, rotating-shift operator basis.

The present ampoule filling and sealing machine provides several salient advantages. Some of these advantages have been mentioned above; however, in the overall sense, the principal advantage is that because of the various improvements in all of the stations, a faster output of as high as 300 filled and sealed ampoules per minute is attained with smaller sized ampoules, and even with larger ampoules the output rate is vastly improved, up to about 150 ampoules per minute. In addition to a faster output, the present machine is almost totally automatic and eliminates most of the operator manpower required by prior art machines, thus lowering labor costs. The machine is compact, thereby conserving space in the clean room, i.e. the sterile environment where the ampoules are filled. As mentioned above, the machine is capable of running continuously. This is especially important with regard to the endless chain drive on which is mounted the plurality of cylindrical rollers. In prior art machine configurations, the machines often have to be stopped periodically for loading and unloading, to remove broken ampoules, or to eliminate surges, jamming, etc., all of which is obviated and avoided by the present machine.

The invention consists in the features of construction, combination of elements, and arrangement of parts which will be exemplified in the device hereinafter described and of which the scope of application will be indicated in the appended claims.

BRIEF DESCRIPTION OF THE DRAWINGS

In the accompanying drawings in which is shown one of the various possible embodiments of the invention:

FIG. 6 is a sectional elevation view of an alternative ampoule-bridge breaking means in the feeding station, i.e., the agitator;

FIG. 7 is a plan view of the agitator of FIG. 6;

DETAILED DESCRIPTION OF THE PREFERRED EMBODIMENTS

Figure 1:
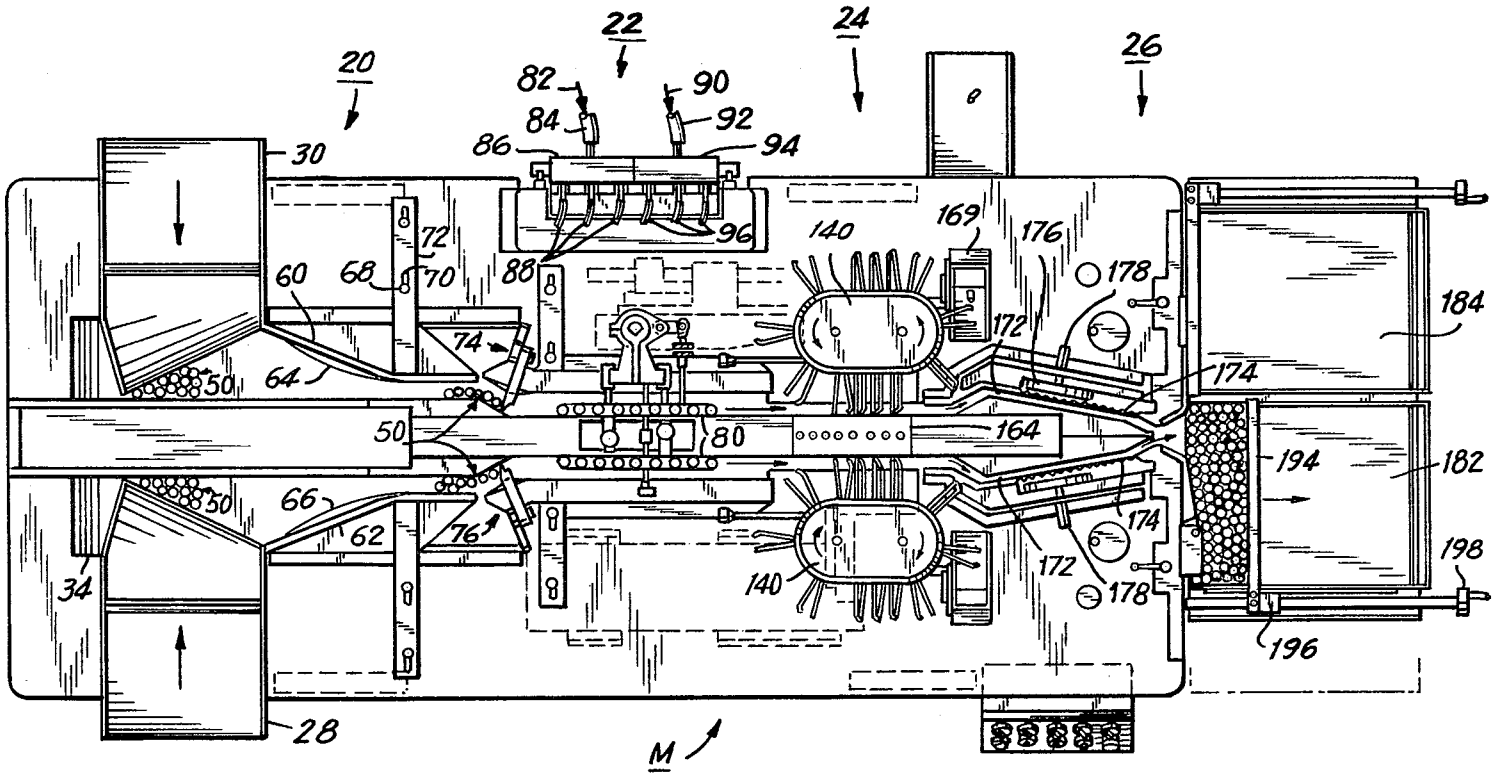
FIG. 1 is a plan view of the machine.
Figure 2:
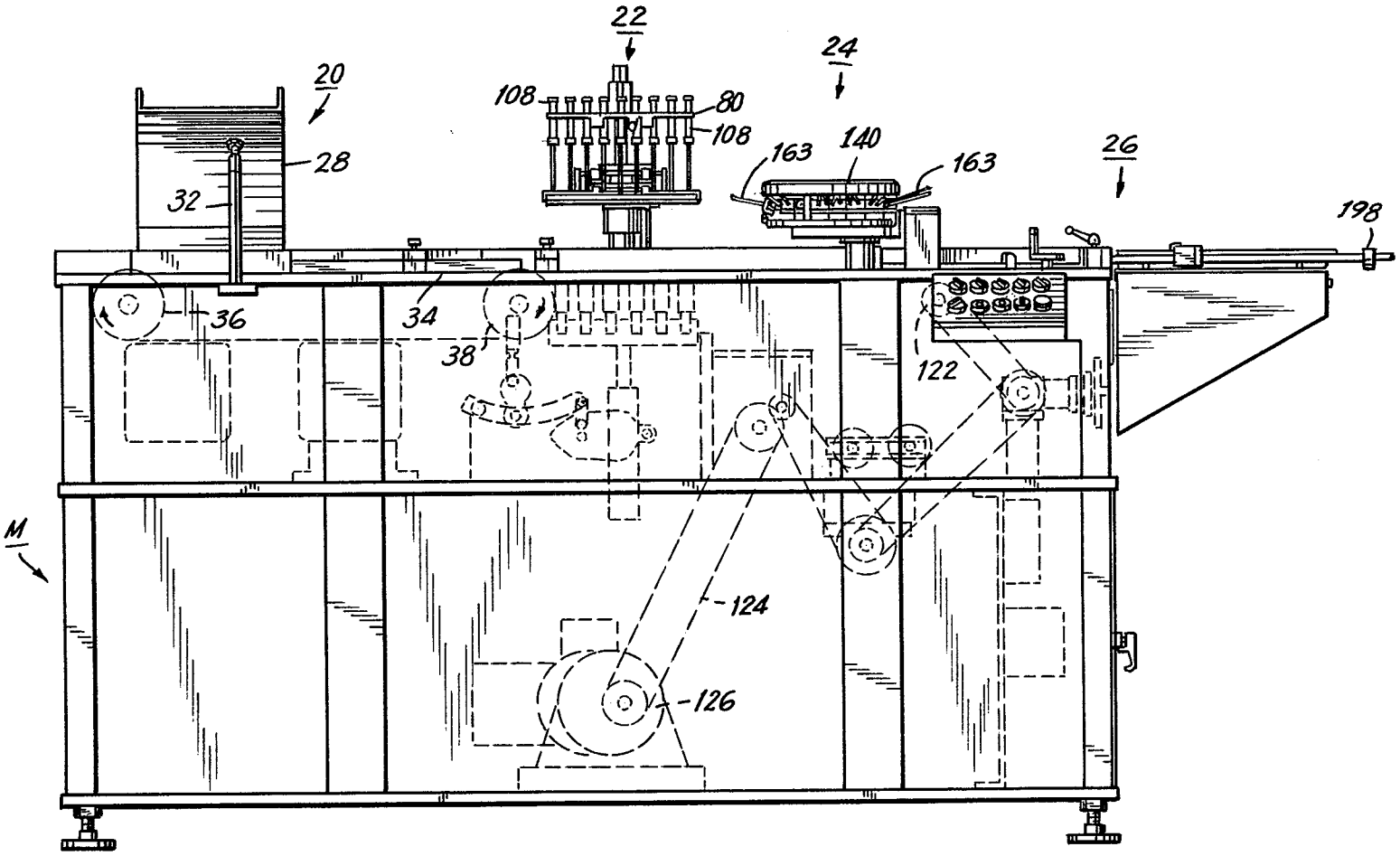
FIG. 2 is an elevational view of the machine.

Referring now to FIGS. 1 and 2, the machine M includes an empty ampoules feeding station 20, a filling station 22, a sealing station 24 and a loading station 26. The ampoules move from left to right through the machine stations. In this preferred embodiment of the invention, one commercial form of the machine is shown having two parallel lines of ampoules and mirror image elements on opposite sides of a central longitudinal vertical plane through the machine. As will appear below, a central horizontally oriented endless chain drive simultaneously moves two lines of ampoules successively through the filling station 22 and the sealing station 24. Two parallel lines of cylindrical rollers are mounted on the endless chain drive, each line of cylindrical rollers serving to move a different line of ampoules and each ampoule of a line being disposed between two adjacent rollers as mentioned above.

Figure 3:
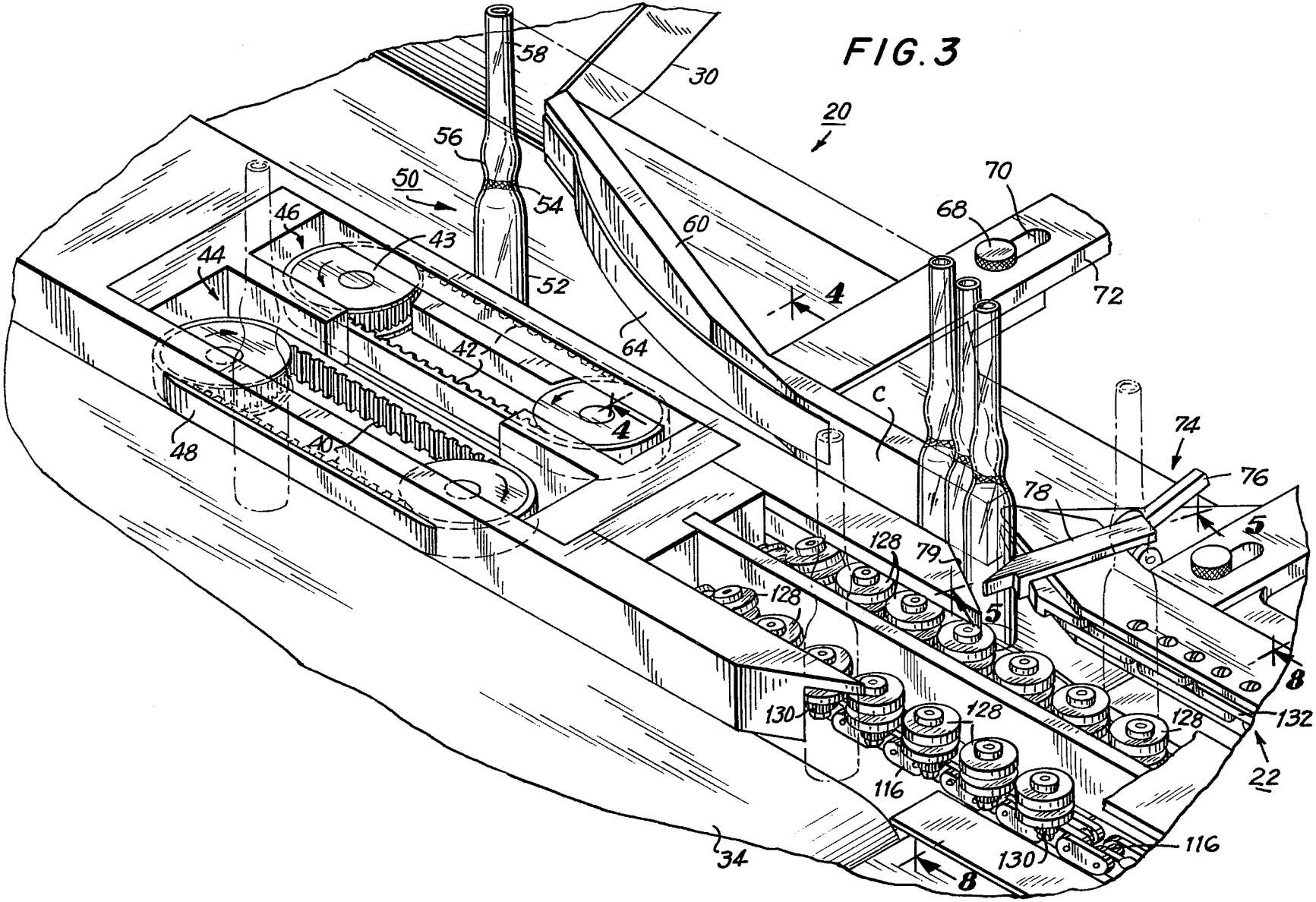
FIG. 3 is an enlarged perspective view of the empty ampoules feeder station and the inlet portion of the filling station; a portion of the central endless chain drive and associated cylindrical rollers is shown.
Figure 5:
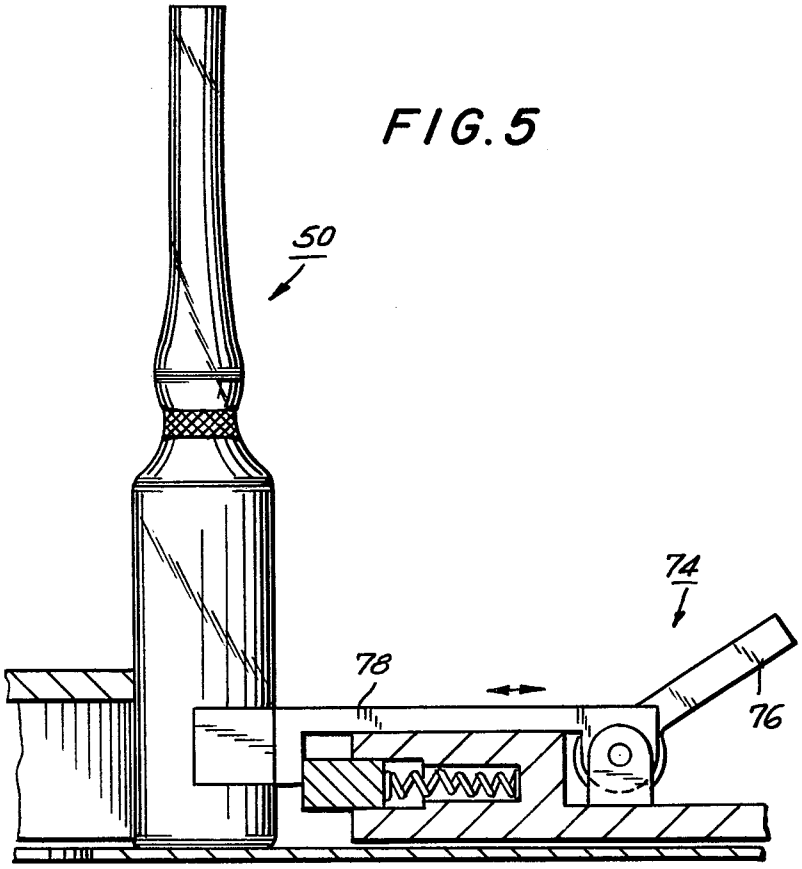
FIG. 5 is a sectional elevational view of another portion of FIG. 3, taken substantially along the line 5—5 of FIG. 3.

The feeding station 20, as shown in FIGS. 1, 2 and 3, has inclined trays 28 and 30, one for each line, to receive empty ampoules, bottom down, from a suitable supply. A batch of empty ampoules is manually loaded onto each tray 28 and 30 from a shipment carton which, as is known in the art, is so constructed that an entire batch of empty ampoules may be uniformly loaded onto either tray 28 or 30 at once, without individual emplacement of each ampoule. Each tray 28 and 30 is inclined downwardly toward the central longitudinal axis of the machine, so that the empty upright ampoules slide toward the center of the machine on the smooth upper surface of the inclined tray which usually is composed of polished stainless steel. Suitable means such as a rod 32 (FIG. 2) supports each tray, e.g. the tray 28, in the aforesaid inclined position.

A first horizontal endless belt 34, which usually is a metal strip, e.g. polished stainless steel, is centrally disposed below and bridges the space between the inner lower edges of both of the trays 28 and 30. The belt 34 has a horizontal upper reach which moves in a horizontal plane toward the filling station 22. The belt 34 is mounted on rotating pulleys 36 and 38 (FIG. 2), one of which is driven.

Figure 4:
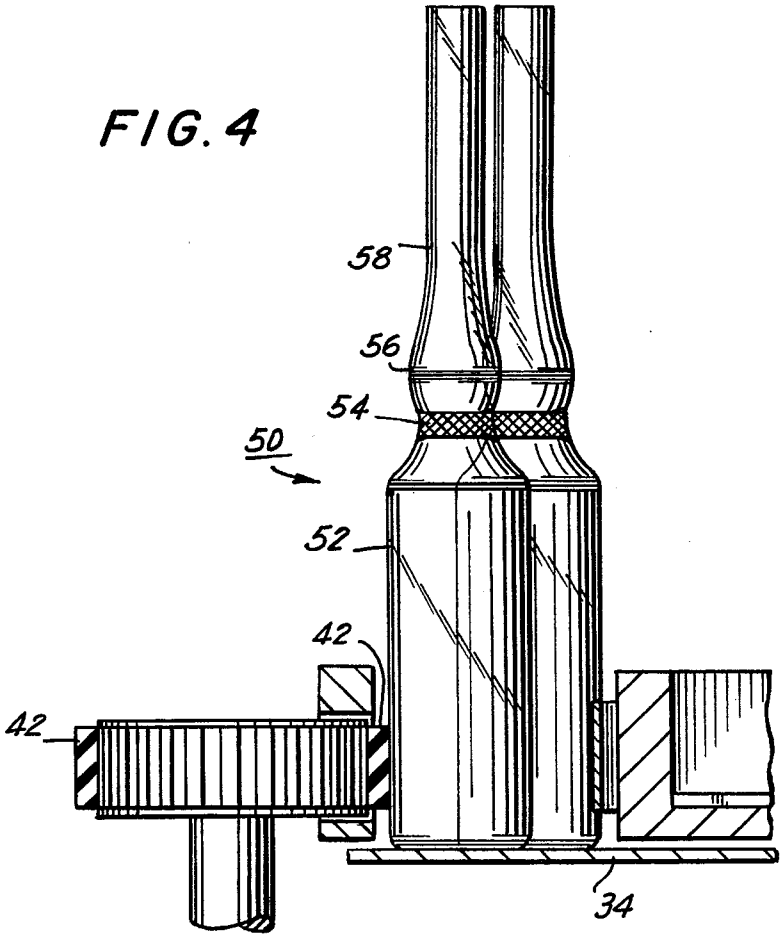
FIG. 4 is a sectional elevational view of a portion of FIG. 3, taken substantially along the line 4—4 of FIG. 3.

The second horizontal endless paired side belts 40 and 42 (FIGS. 3 and 4) are composed of non-metallic elastomeric material, e.g. neoprene, and are centrally disposed above the belt 34 on opposite sides of the central axis of the machine. A vertical outer reach of each side belt 40 and 42 moves horizontally toward the filling station 22.

Thus both lines of empty ampoules rest on the belt 34 and each line of empty ampoules is contacted by an outer reach of a respective side belt 40 or 42, so that empty ampoules, after sliding downwardly on the inclined trays 28 and 30, move onto the belt 34 and are urged toward the filling station 22 by the bottom belt 34 and the side belts 40 and 42.

As shown in FIG. 3, each side belt 40 and 42 is located in a respective compartment 44 and 46 within the upper body of the machine, and each side belt 40 and 42 is provided with inner teeth which cooperate with toothed pulleys 43 of which one for each belt is driven, so that positive motion of the belts without slippage is attained. The side belts 40 and 42 move at a linear speed which is greater than the linear speed of the bottom belt 34, and which is typically about twice the linear speed of the bottom belt 34, so that the central and upper portion of each ampoule touching a side belt is positively urged forwardly without any danger of an ampoule falling down backwards on the bottom belt 34. These different speeds can be employed due to the smooth surface of the bottom belt. To further ensure the proper seating of the empty ampoules on the bottom belt 34, each side belt 40 and 42 is inclined downwardly toward the filling station 22, the inclination being so slight that it cannot be seen in the figures. The vertically oriented surfaces of the side belts 40 or 42 that are in contact with the ampoules, e.g. the surface 48 of the side belt 40 (FIG. 3), protrude outwardly from the wall of the compartment 44, typically about 0.015 inches, so that positive contact between belts 40 or 42, and the respective line of ampoules, is assured.

An ampoule 50 (see FIGS. 3 - 8) has a cylindrical body 52, a ceramic bead 54 around a narrow upper waist above the body 52, an upper bulbous section 56 and a narrow elongated neck 58. In some instances, depending on ultimate function and usage, the ceramic bead 54 and/or the bulbous section 56 may be omitted. However, generally speaking, all types of ampoules will be provided with at least a body, to receive the filling of liquid, and a neck at which the ampoule is sealed after filling.

In order to convert the batch of empty ampoules into a line of ampoules at the feeding station 20, they initially are conveyed toward the filling station by horizontal baffles 60 and 62 sited above the belt 34. Each baffle 60 or 62 is oriented at an acute angle with respect to the central axis of the machine so that the ampoules are guided to a single file or single line of ampoules. Each baffle 60 or 62 preferably is provided with an attached respective inner inwardly convex spring plate 64 or 66 for surge accommodation, and to aid in preventing bridging of the ampoules, especially when the ampoules are down to two abreast between the outer reach of a side belt and the downstream end of the baffle. The baffle and spring plate arrangement best is shown in FIG. 3 where it will be seen that the upstream end of the spring plate is fixed to the baffle, the other end of the plate is free and the intermediate section of the plate is bowed inwardly and spaced from the baffle. Adjustment means such as set screw 68 having a knurled head (FIG. 3) and extending into a slot 70 in a bar 72 is provided so that the position of the baffle 60 and its attached spring plate 64 may be altered to accommodate ampoules having different body diameters. Similar considerations apply to the baffle 62 and the plate 66 (see FIG. 1).

Finally, the feeding station 20 is provided with a gate means 74 and 76 on the outer side of the lines of ampoules in a single file channel C downstream of the side belt, so that the feed of empty ampoules may be manually controlled to start or stop. Each gate means constitutes a lever having a handle 76 and a stop arm 78. The gate moves in a horizontal plane perpendicular to the ampoule flow. When the gate means is closed, each line of ampoules is stationary and merely slides on the fowardly moving belt 34. Beyond the gate means the single file channel has a centrally inclined jog 79.

Referring now to FIGS. 6 and 7, an alternative means for feeding the ampoules entails the provision of a reciprocating agitator having vertical serrations, instead of the second horizontal belt with vertically oriented reach. Thus, the empty ampoules 50 pass adjacent to and contiguous with the horizontally oriented agitator member 51 which consists of, typically, a plastic member which has straight vertical serrations 53 which reciprocate against the ampoule sides causing jams to dislodge. Referring now especially to FIG. 6, the plastic agitator member 51 is provided with a reciprocating horizontal movement, within a track or frame, by the provision of beam 55 which is pivoted at its lower end (pivot 57). The upper end 59 of member 55 is attached to member 51 by a joint having vertical play, i.e. a slot 61. Reciprocating motion of member 55 is attained by the provision of beam 63, the free end 65 of which is pivotally attached to member 55. The outer end 67 of beam 63 is attached asymetrically to gear 69 which in turn is rotated by drive gear 71, so that beam 63 moves back and forth and thus causes member 55 to pivot as shown by arrows 73, and a reciprocating motion of member 51 is attained.

Referring now to the filling station 22, and especially to FIGS. 1, 2, 8 and 9, duplicate filling means are provided on both sides of the machine to fill ampoules on both lines simultaneously. Each filling means accomplishes three procedural steps, namely, a first step during which a first group of three empty ampoules are purged with nitrogen, a second step in which a second adjacent downstream group of three ampoules are filled with liquid medicament, and a third step in which a third adjacent group of three filled ampoules have their head spaces in the necks purged with nitrogen. Each group of three ampoules passes seriatim through the three steps. The three steps are accomplished in the filling station 22 by two linear arrays of nine nozzles on a walking beam 80, a different array for each of the two lines. The nitrogen purges are unvalved continuous-flow operations, in other words gaseous nitrogen flows continuously out of the first three and last three nozzles in each array of nine nozzles, to accomplish the first and third steps in the filling sequence.

Referring to FIG. 1, a liquid medicament fill stream 82 for the second step in the filling sequence passes via a plastic hose 84 to a valve 86 and from the valve 86 to three smaller plastic hoses 88, each of which extends to a different one of the middle three nozzles of each array of nozzles on the walking beam 80. The actual connection of the hoses 88 and the mechanisms have not been shown; the operation of this aspect of the filling sequence is well understood by those skilled in the art. A second liquid medicament fill stream 90 for the second step in the filling sequence passes via a plastic hose 92 to a valve 94 and from the valve 94 to three smaller plastic hoses 96, each of which extends to a different one of the middle three nozzles of the opposite array of nine nozzles on the walking beam 80.

Figure 9:
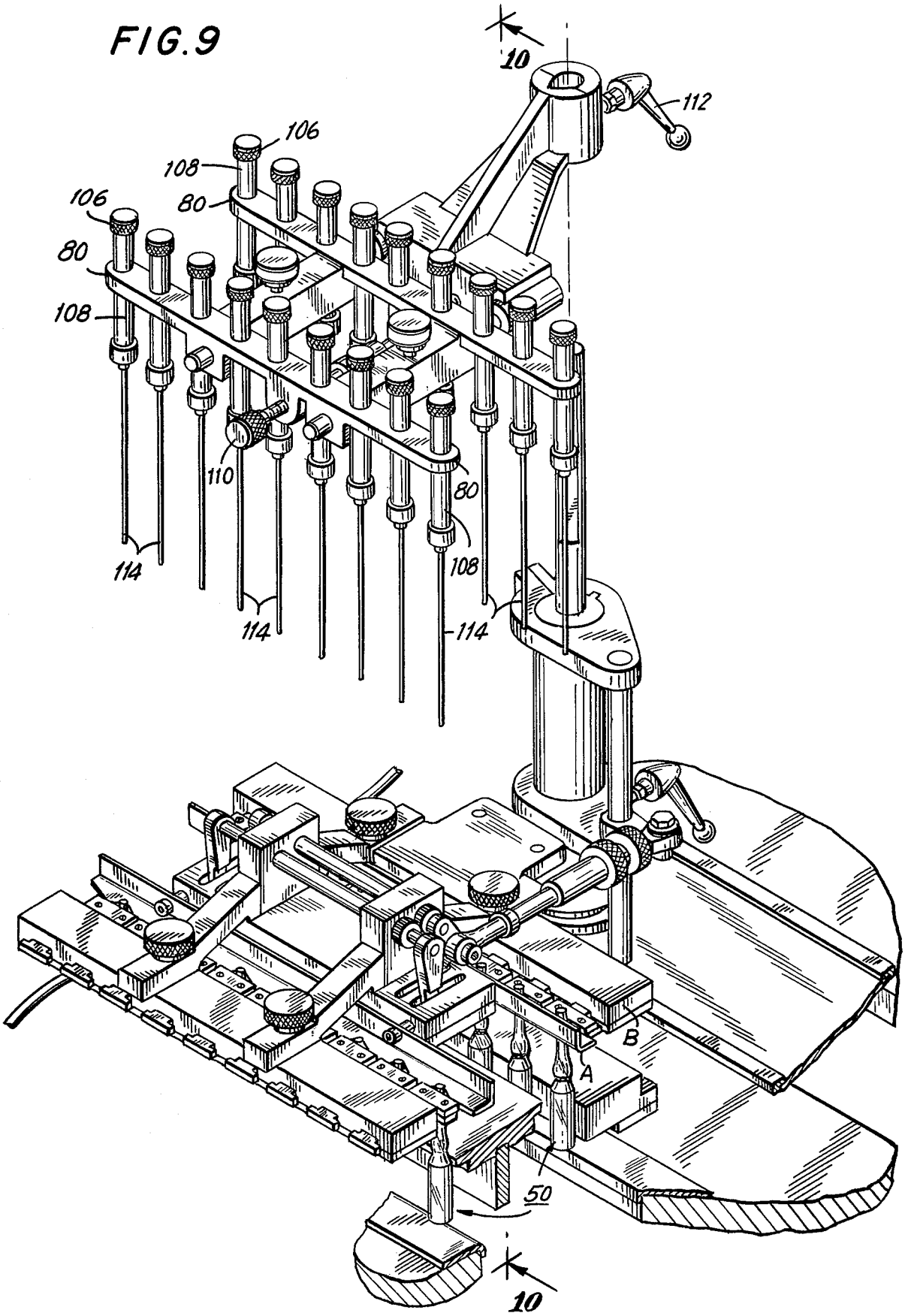
FIG. 9 is an exploded perspective view of the filling station.
Figure 10:
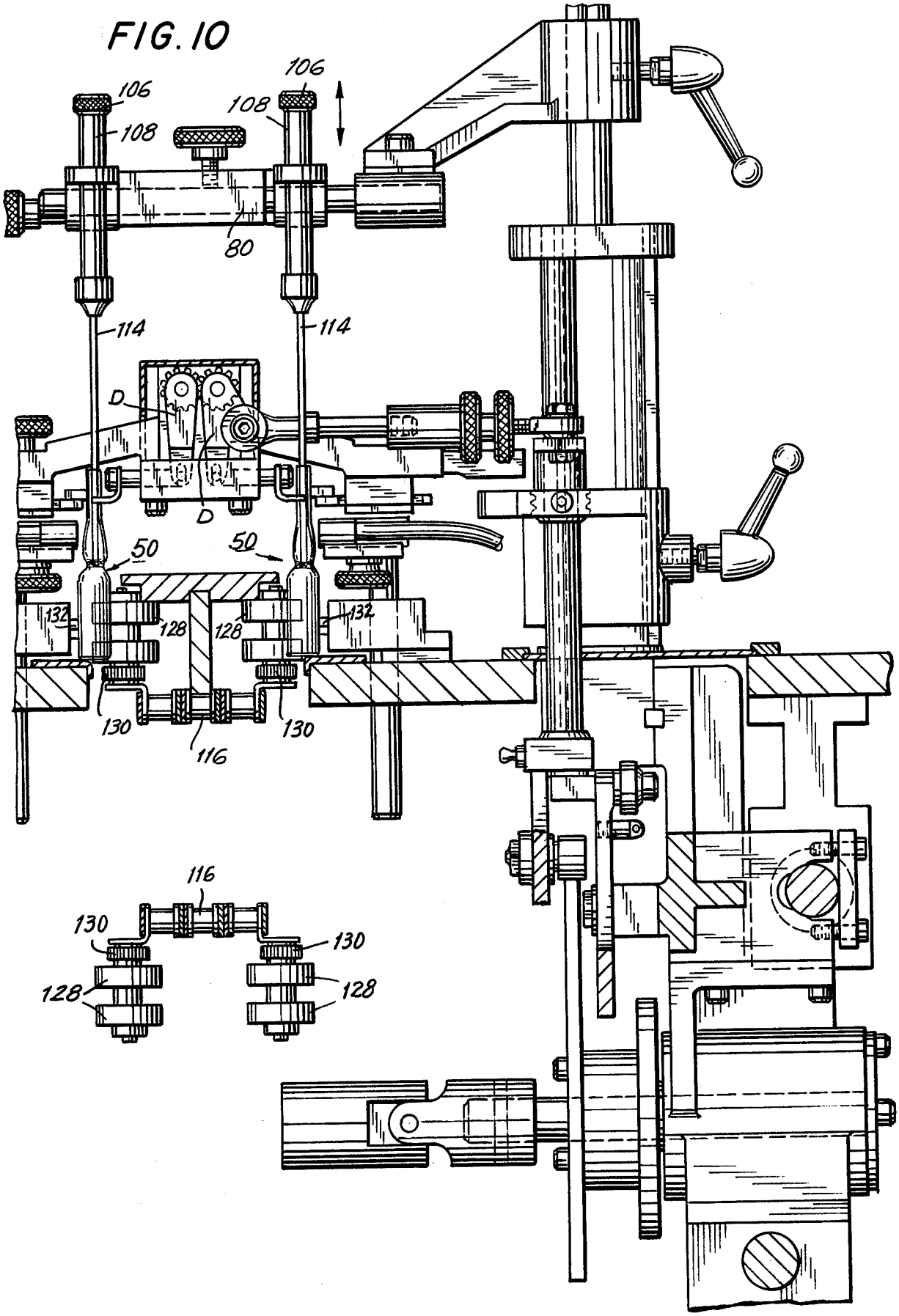
FIG. 10 is a sectional elevational view of FIG. 9, taken substantially along the line 10—10 of FIG. 9.

The walking beam mechanism and operation is known to those skilled in the art and is, per se, conventional; it generally is an integral part of any ampoule filling station and has been shown to some extent in FIG. 9. The knurled knobs 106 on the tops of the nozzles 108 are for clamping the nozzles in place; a knob 110 controls transverse spacing of the two arrays of nozzles; an adjustment lever 112 controls the positions of the nozzles at the top of their strokes whereby to accomodate different heights of ampoules. The linear arrays of nozzles are disposed above the moving lines of ampoules, and the walking beam 80 moves the arrays in regular sequence at the filling station 22, i.e. downward so that the hollow needles 114 extend into the necks of the ampoules as shown in FIG. 10, forward by a group of three ampoules and at a speed synchronized with the speed of advance of the line of ampoules while fill liquid is being discharged into the ampoules from the middle three needles 114, upward so that the needles 114 are spaced above the necks of the ampoules, and backward to the former walking beam position, after which the sequence is repeated. The timing and valving mechanisms for this sequence are well known in the art and will not be described herein in the interest of brevity. It is evident, for example, that timing of the valving is such that fill liquid is discharged from the nozzles 108 through the middle three needles 114 and into the ampoules only during the period of the sequence when the walking beam and its appurtenances including the nozzles 108 are in the down position and moving forward in synchronism with the ampoules, and with each of the middle three needles 114 extending into the neck of an ampoule.

Referring now to FIGS. 3, 8, 10 and 11, a salient aspect of the invention is the provision of a new configuration of means for moving the two parallel lines of ampoules successively at a steady rate, without stopping, through the ampoule filling and sealing stations of the machine. This new configuration of said means, in a general sense, is applicable to the moving of one or more parallel lines of ampoules. As shown especially in FIGS. 3 and 11, a horizontally oriented endless chain drive 116 is provided which has an upper horizontal reach that moves forwardly through the machine and a lower return reach. The chain 116 is trained about two horizontally spaced vertical sprockets 118, one of which is turned by drive means including a pulley 122 on a shaft connected to the sprocket 118. A belt and pulley drive train 124 extends from the pulley 122 to an electric motor 126. The same motor 126 powers all other moving parts, e.g. the bottom belt 34, the side belts 40, 42, the walking geam 80 and moving parts at the sealing station so that all operations are performed on the ampoules in synchronism.

Figure 8:
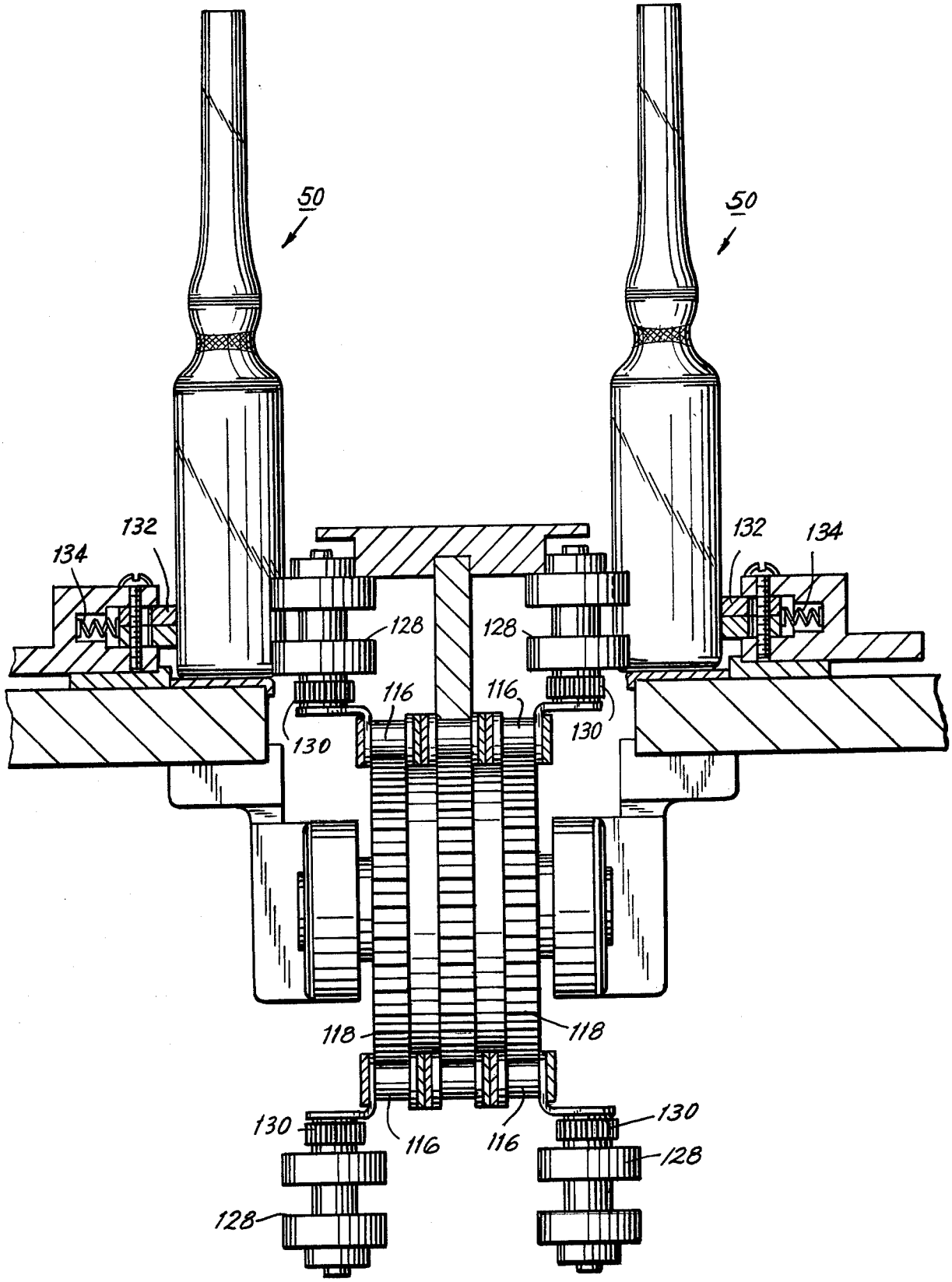
FIG. 8 is a sectional elevational view of still another portion of FIG. 3, taken substantially along the line 8—8 of FIG. 3.

Two lines of identically spaced apart identical rollers 128 are mounted on the drive chain 116. The central axis of each roller 128 is perpendicular to the drive chain and each roller 128 is mounted on ball bearings or the like so that it is free to rotate about its central axis. As is best shown in FIGS. 8 and 10, each roller 128 has fixed to it a coaxial pinion 130 which is disposed between the roller 128 and the drive chain 116. As will appear below, the pinion is engaged by a rack as the ampoules move through the sealing station. The rollers precisely position the ampoules during movement through the filling and sealing stations to enable the sundry mechanisms at these stations to perform operations on the moving ampoules.

Referring now especially to FIG. 3, as the lines of ampoules move forwardly from the feeding station 20, they are individually picked up by and engaged between adjacent rollers 128 and are moved forwardly in two parallel lines into the filling station 22. The disposition of the ampoules between adjacent rollers is as described above; the vertical plane through the central axis of each line of ampoules is parallel to the vertical plane through the central axis of the respective line of rollers and outside this vertical plane with respect to the central longitudinal vertical plane of the machine, as best is shown in FIGS. 8 and 10. A portion of the perimeter of each ampoule is engaged at the outlet of the jog 79 by the perimeters of the two adjacent rollers so that the ampoules are driven forwardly into the filling station 22.

Lateral outward movement of the ampoules is prevented, and the ampoules ae precisely positioned at the filling station 22 by a plurality of individual rails 132 arranged in a straight line starting at the outlet of the jog 79 on the outer side of the line of ampoules. As shown in FIG. 8, each rail is biased toward the drive chain by a spring 134. The spring loaded rails 132 thus urge the line of ampoules snugly against the line of cylindrical rollers 128 and toward the central longitudinal vertical plane of the machine, so that the ampoules are precisely aligned during their procession through the filling station 22. The final rail of the line of rails generally will not be spring-loaded and will be relieved, i.e. the final rail preferably will be stationary, to provide the ampoule with clearance within its nest. This is to insure that any ampoules which have risen during filling will fall, coming to rest on the wear strip 34.

Figure 11:
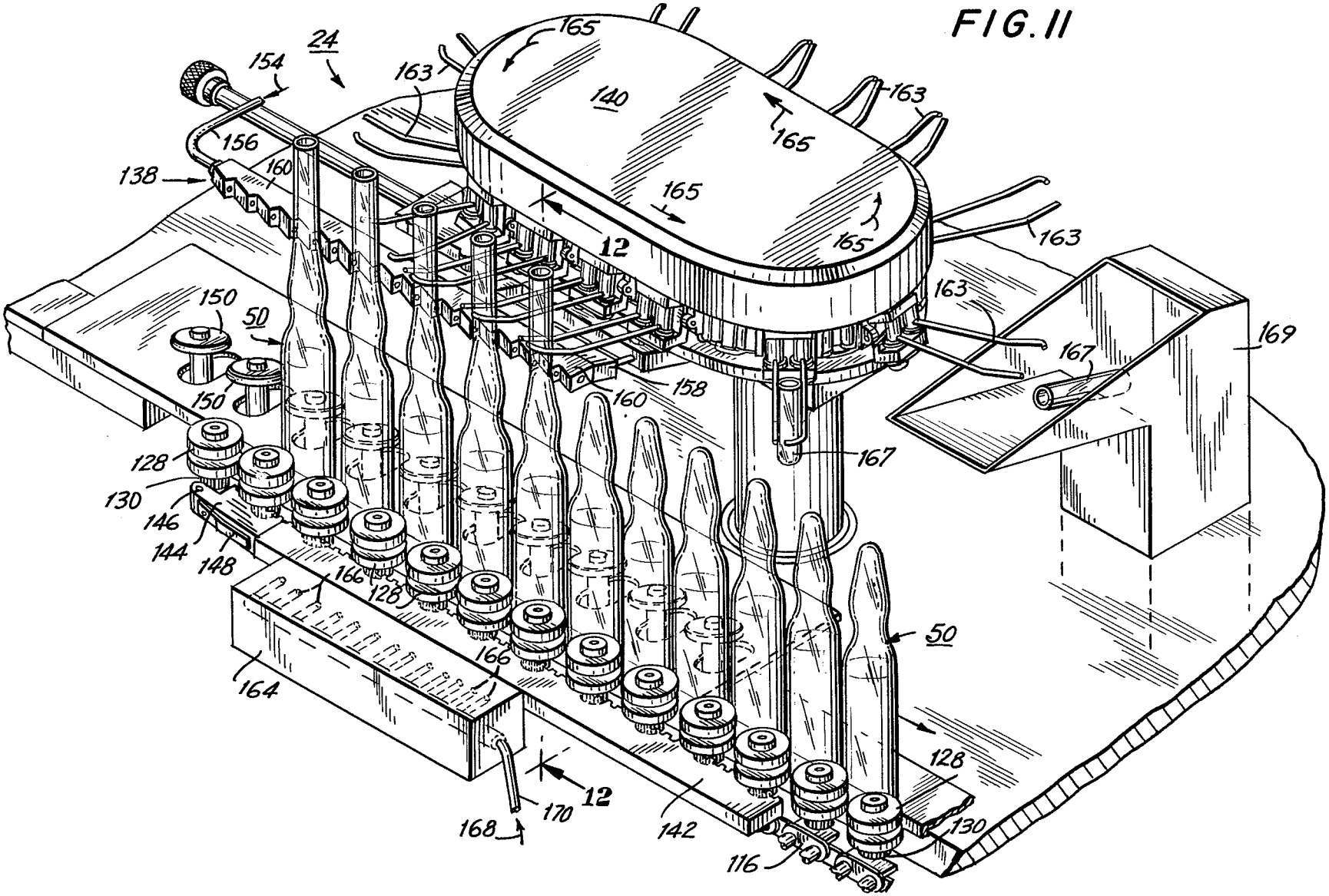
FIG. 11 is a perspective view of the sealing station.
Figure 12:
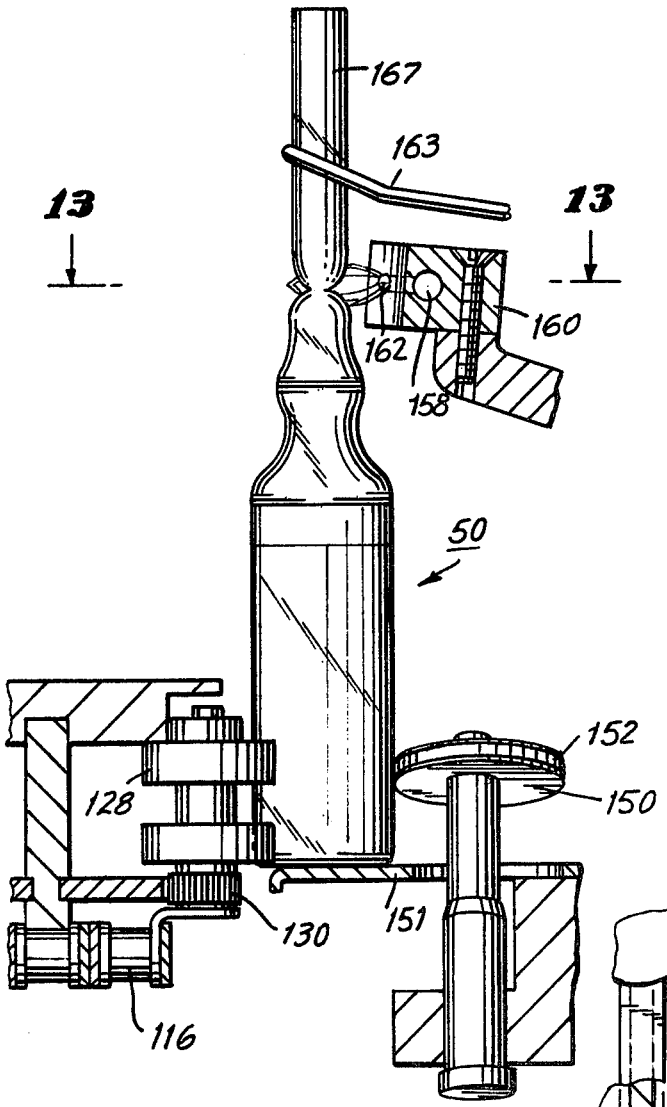
FIG. 12 is a sectional elevational view of FIG. 11, taken substantially along the line 12—12 of FIG. 11.
Figure 13:
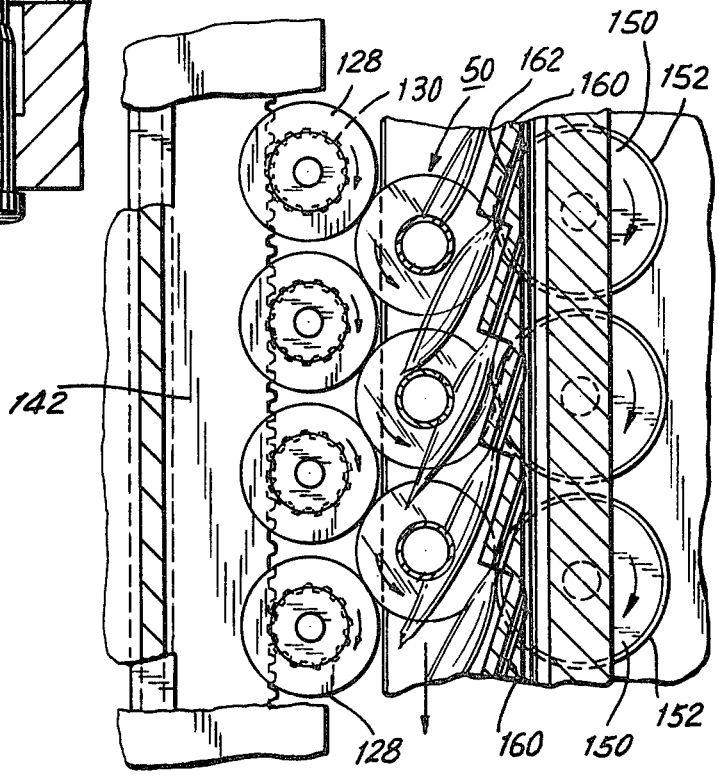
FIG. 13 is a sectional plan view of FIG. 12, taken substantially along the line 13—13 of FIG. 12.

To assist precise positioning of the ampoules being operated upon at the filling station, each line has associated with it at this station a pair of clamps A, B which move upstream and downsteam with the walking beam. The purpose of clamps A and B is to centralize the ampoule neck with the filling nozzles. The clamps B are fixed against movement transversely of the drive chain. Their inner edges are formed by a line of spring loaded rails clear on the line of ampoules. The clamps A have their inner edges notched in registry with the needles 114. Said clamps A are shiftable toward and away from the clamps B by a pair of rocker arms D (FIG. 10) from inner positions in which they clear the necks of the ampoules in the lines to outer positions in which the notches thereon engage the necks of ampoules and press them against the spring-loaded rails in the clamps B. This action lifts the engaged ampoules off the rollers 128 and depresses the rails 132. The fact as to whether the spring loaded rails 132 may or may not be depressed depends on the concentricity of the ampoule diameters and is incidental to the operation of the machine. Since the Referring now to FIGS. 11, 12 and 13, the sealing station 24 is characterized by the provision of burner-sealer means 138, gripper finger means 140 above burner-sealer means 138, and lower means to continually move the line of ampoules through the station 24 while concomitantly rotating the ampoules. The endless drive chain 116 moves the ampoules forwardly through station 24 without stop. The pinion 130 of each cylindrical roller 128 engages the teeth of a fixed toothed linear rack 142, as is best shown in FIGS. 11 and 13. Such engagement is facilitated in a preferred embodiment, without any inadvertent breakage of teeth or stripping of gears, by the provision of a floating toothed lead-in rack 144 upstream of the rack 142, which rack 144 pivots about a fixed vertical mounting pin 146 that is biased toward contact with the pinion 130 of each roller 128 by an inner leaf spring 148 which is actually a compression spring and which bears against a stationary surface (not shown) of the machine to urge the lead-in rack 144 toward the rollers 128. Since the rack 144 is readily displaceable away from the rollers 128, as by misalignment of a pinion 130 with the teeth of rack 144, by the time each roller 128 has moved to the point where the ends of racks 144 and 142 are juxtaposed, the associated pinion 130 will mesh with the teeth of rack 144 and thus a smooth progression of the rollers 128 toward engagement of their pinions 130 with the teeth of rack 142 is attained. As the rollers 128 progress lengthwise of the rack 142, this engagement of the pinions 130 with the teeth of rack 142 positively causes each of the rollers 128 to rotate about its central vertical axis.

The rotation of the rollers 128 causes each of the filled ampoules to spin, i.e. rotate, about its central vertical axis during the burner-sealing step in station 24, so that the glass of the neck of each ampoule is uniformly melted and sealed. The ampoules are urged toward the rotating rollers, and downwardly to a precise position during burner-sealing, by an outer line of spaced apart inclined discs 150 on the outer side of and in contact with the line of filled ampoules. Each of the inclined discs 150 has a resilient outer edge 152 with a high coefficient of friction, generally composed of an 0-ring of neoprene or the like, and each of the discs 150 is tilted downwardly and rearwardly, as best is seen in FIG. 12, so that the ampoules are urged downwardly against a horizontal shelf 151 while they are rotating and thereby are precisely vertically positioned and firmly seated so that the neck of each ampoule has the burner flames played on it as the same location whereby uniformly sealed ampoules, all of equal height, are produced. The angle of incline from the horizontal of the inclined discs typically is about 5 degrees.

The burner means 138 receives a gaseous feed stream 154 consisting of a mixture of gaseous fuel and commercially pure oxygen. The gaseous fuel usually is natural gas principally consisting of methane. The stream 154 flows through a pipe 156 into a manifold 158 (FIG. 13) of a horizontal burner 160, from which juxtaposed individual generally horizontal gas burners 162 discharge individual gas jets that are lit; combustion ensues and the line of flames melts a portion of the neck of each advancing spinning ampoule and concomitantly, by coalescence, seals the neck of the ampoule. The gas burners 162 are aligned in parallel at an acute angle to the forward direction of travel of the ampoules, so that a flame is emitted from each gas burner 162 with a component of motion in the direction of travel of the ampoules.

Figure 14:
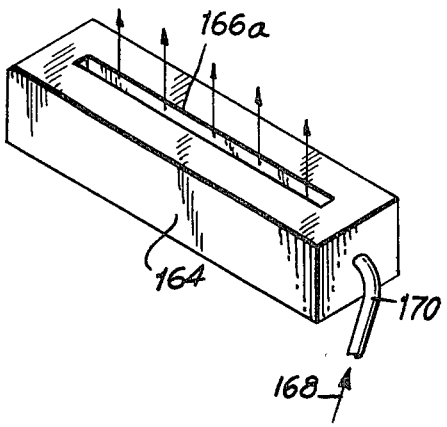
FIG. 14 shows an alternative manifold configuration.

As best seen in FIG. 11, and since in this embodiment of the invention the ampoules travel in two parallel lines past two parallel outer burners, a central linear air curtain manifold 164 is provided. The manifold 164 has a linear group of spaced apart top openings 166. An air stream 168 flows through a pipe 170 into the manifold 164, so that air streams discharge upwardly from the openings 166 and form a linear air curtain between the two parallel lines of ampoules, whereby cross-over heating is inhibited. The openings 166 constitute drilled holes in the manifold 164; the holes usually will be inclined at an acute angle from vertical, typically about 30 degrees, with an inclination such that the air curtain is emitted with a component of motion in the direction of travel of the lines of ampoules. FIG. 14 shows an alternative configuration of minifold 164 in which a straight linear slit or slot **166*a* is provided, from which a continuous air curtain is emitted. The air stream is supplied via stream 168 as described supra. Typically the slot 166*a* is about 0.003 inch wide and extends centrally along the length of the manifold 164**. This provides a continuous wall of vertically flowing air.

The configuration of the gripper finger means 140 is generally conventional and will only be briefly described. Gripper finger pairs 163 move in the direction indicated by the arrows 165 shown on top of the unit, their mountings being such that the gripper fingers 163 of each pair sequentially converge and grip an upper neck portion 167, are raised to lift the upper neck portion 167 upwardly and away from the main body of the ampoule as the burner flame strikes the neck and melts and seals the neck, so that the glass becomes fluid where the burner flame strikes the neck, and finally the gripper fingers 163 diverge so that the separated neck portion 167 drops into a chute 169 and passes to waste removal. Movement of the gripper fingers is synchronized with movement of the main drive chain.

Figure 16:
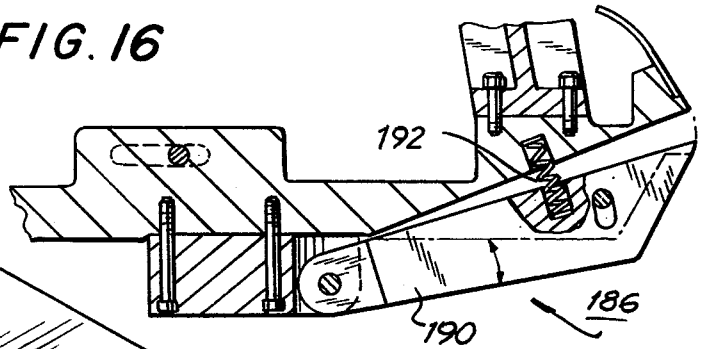
FIG. 16 is a sectional plan view of a portion of FIG. 15, taken substantially along the line 16—16 of FIG. 15.
Figure 15:
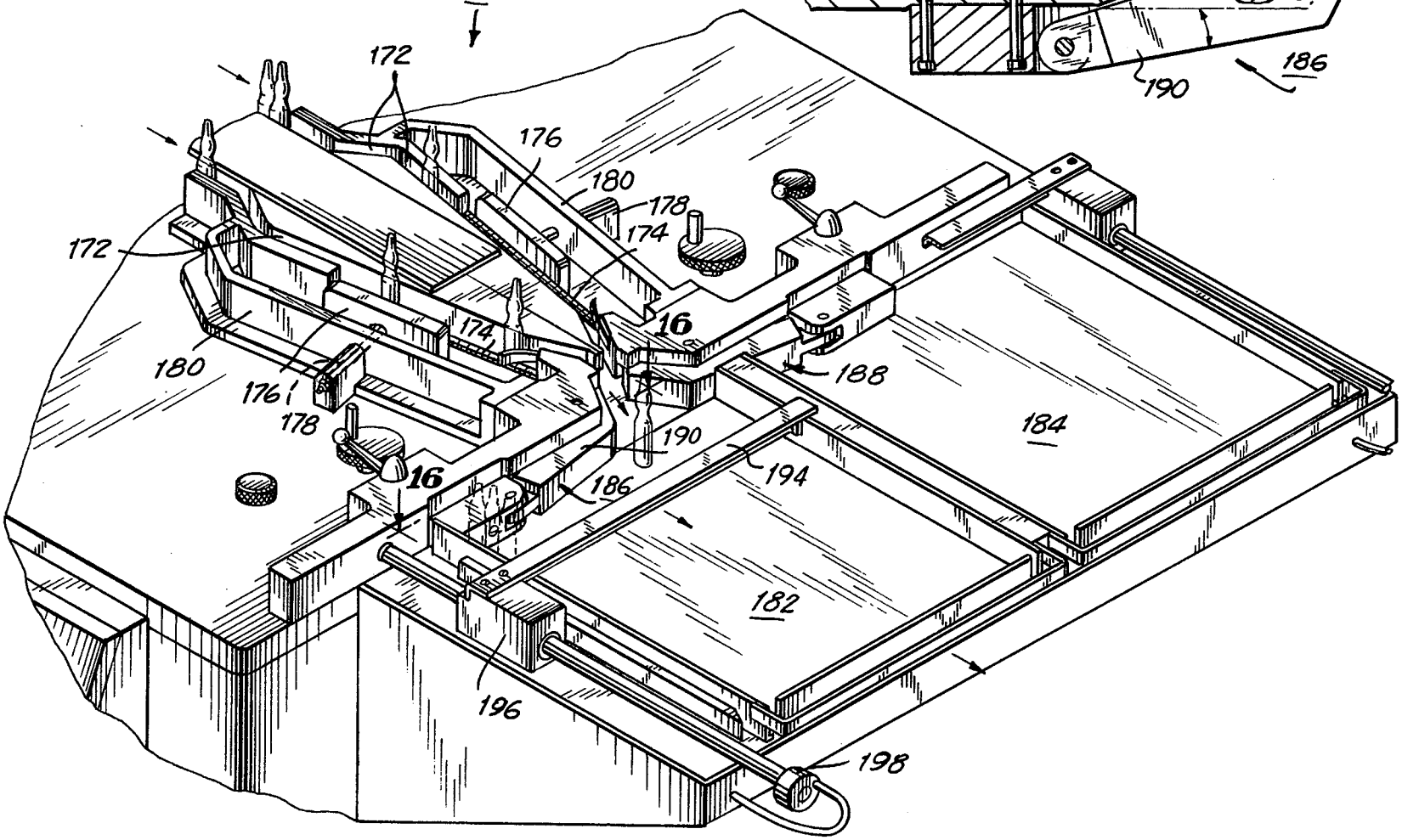
FIG. 15 is a perspective view of the loading station.

Referring now to FIGS. 1, 15 and 16, the loading section 26 of the machine includes a discharge channel 172 to receive a single file line of sealed ampoules from the sealing section 24. The outer side of the middle portion of channel 172 is provided with an elongated horizontal spring 174 for surge accommodation as discussed above, a spring-loaded backing bar 176 being disposed behind the spring 174. The loading spring 178 for bar 176 is shown in FIG. 15. A baffle 180, typically a barrier or other stop means, is spaced outwardly from the backing bar 176 and mounted on a fixed support, e.g. the framework of the machine. The surge accommodation aspect of the loading station 26 entails a build-up and hold-up of sealed ampoules within the channel 172, so that the sealed ampoules are not forced onto a full tray, which could lead to undesirable ampoules pile-up and/or breakage. The surge accommodation is attained by a build-up of ampoules in the channel 172, with the spring 174 deforming outwardly against the backing bar 176 which moves horizontally away from the central longitudinal vertical plane of the machine. Surge accommodation is limited by the bar 176 contacting the baffle 180.

Two horizontal discharge trays 182 and 184 are disposed at the common outlet of the channels 172, and suitable means, e.g. a pneumatic drive or levered mechanism, is provided to alternately shift the trays laterally so that the tray 182, which is shown being loaded, may be removed and replaced with an empty tray while the tray 184 is being filled. Spring-loaded gate means 186 and 188 are provided, respectively, for the trays 182 and 184.

Referring to FIG. 16, the gate means 186 includes a pivoted arm 190 and a backing spring 192. The purpose of gate means 186 and 188 is to urge the filled and sealed ampoules onto the tray 182 and against a movable linear bar 194 which is perpendicular to the channel 172. As the tray 182 fills with ampoules, the bar 194 moves away from gates 186 and 188, and as shown, the bar is provided with a traveller 196 which contacts a switch 198 when the tray 182 is full of ampoules, so as to direct ampoules feed to the empty tray 184 by automatic lateral shifting of the tray positions. Thereafter, the tray 182 is manually removed and replaced with another empty tray, and the sequence is repeated.

It thus will be seen that there is provided an ampoule filling and sealing machine which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense.

Having thus described the invention, there is claimed as new and desired to be secured by Letters Patent:

1. In an ampoule filling and sealing machine, an apparatus for moving a line of ampoules successively through a filling station and a sealing station of said machine, said apparatus comprising a horizontally oriented endless drive chain trained about two horizontally opposed aligned vertically oriented sprockets, means to rotate at least one of said sprockets a plurality of spaced apart cylindrical rollers mounted on said drive chain, the central axis of each of said rollers being vertical, an ampoule being receivable between each pair of adjacent rollers, means to define a channel in conjunction with the rollers on a reach of the drive chain, each of said rollers being provided with a functionally integral pinion, a first rack at the sealing station, said pinions being engageable with said first rack so that the ampoules are rotated as they move through the sealing station and means to facilitate engagement of said pinion with said first rack.

2. The apparatus of claim 1 in which the first rack is preceded by a juxtaposed floating rack so that the pinion of each roller is preparatorily alinged with the teeth of the first rack.

3. The ampoule filling and sealing machine of claim 1 in which the line of ampoules is formed in an empty-ampoule feeding station comprising an inclined tray to receive empty ampoules base down, a belt having a horizontal reach below the lower edge of said tray, movable means having a vertical reach above said horizontal reach, and means to move the reach of said belt horizontally toward the filling station, so that empty ampoules sliding downwardly on said inclined tray onto said reach are moved toward the filling station by the reach of said belt and said movable means.

4. The ampoule filling and sealing machine of claim 1 in which the ampoules travel in two parallel lines past and between two parallel outer burner means in the ampoule sealing station, a central linear air curtain manifold having at least one top opening between the two lines of ampoules, and means to direct air into said manifold, so that a linear air curtain is provided between the two lines of ampoules.

5. An empty-ampoule feeding station of an ampoule filling and sealing machine comprising an inclined tray to receive empty ampoules base down, a belt having a horizontal reach below the lower edge of said tray, movable means having a vertical reach above said horizontal reach, and means to move the reach of said belt horizontally toward the filling station, so that empty ampoules sliding downwardly on said inclined tray onto said reach are moved toward the filling station by the reach of said belt and said movable means.

6. The apparatus of claim 5 in which the movable means is a second belt, together with means to move the vertical reach of said second belt horizontally toward the filling station.

7. The apparatus of claim 6 in which the means to move the reaches moves said second reach at a linear speed greater than the linear speed of the first reach.

8. The apparatus of claim 7 in which the linear speed of the second reach is about twice the linear speed of the first reach.

9. The apparatus of claim 6 in which the first reach has a coefficient of friction that is lower than that of the second reach.

10. The apparatus of claim 9 in which the first belt is stainless steel and the second belt is rubber.

11. The apparatus of claim 6 in which the second belt is inclined slightly downwardly toward the filling station.

12. The apparatus of claim 5 in which the movable means is a reciprocating agitator having straight vertical serrations.

13. The apparatus of claim 12 in which the agitator is composed of a plastic.

14. The apparatus of claim 12 in which the reciprocating agitator is agitated by the provision of a first beam having a free end and a pivoted fixed end, the free end of said first beam being attached to the agitator by a joint having vertical play, together with a second beam having a free end which is pivotally attached to said first beam and an opposite end which is asymetrically attached to a rotating member, so that said second beam moves back and forth causing said first beam to pivot about its pivoted fixed end and thereby to alternately reciprocate the agitator forwards and backwards.

15. An ampoule filling station of an ampoule filling and sealing machine, said station comprising a walking beam purger-filler, means drivingly engaging one side of a line of empty ampoules to move said line continually below said purger-filler, means to slidably engage the other side of said line, said last-named means comprising a plurality of aligned rails, said rails being movably spring-loaded toward said line except for the final rail, said final rail being stationary, and means to intermittently positively engage ampoules below the purger-filler to synchronize them with said purger-filler, said last-named means shifting the ampoules engaged thereby away from the drivingly engaging means.

16. In an ampoule sealing station of an ampoule filling and sealing machine provided with burner means, gripper finger means, means to move a line of filled ampoules through said ampoule sealing station, and means to rotate filled ampoules, the improvement comprising means for urging filled ampoules downwardly to a predetermined position during burner-sealing which comprises a line of spaced apart inclined discs on one side of and in contact with a line of linearly moving filled ampoules, each of said inclined discs having a resilient periphery and a downstream inclination.

17. The ampoule sealing station of claim 16 in which the peripheries of the inclined discs are rubber.

18. The ampoule sealing station of claim 16 in which the angle of inclination from the horizontal is about 5°.

19. An ampoule sealing station in which ampoules travel in two parallel lines past and between two parallel outer burner means, a central linear air curtain manifold having at least one top opening between the two lines of ampoules, and means to direct air into said manifold, so that a linear air curtain is provided between the two lines of ampoules.

20. The ampoule sealing station of claim 19 in which the manifold is provided with a plurality of spaced apart top openings arranged in a straight linear orientation between and parallel to the outer burner means.

21. The ampoule sealing station of claim 20 in which the air outlet openings in the air manifold are at an acute angle to the vertical.

22. The ampoule sealing station of claim 21 in which the air curtain is emitted with a component of motion in the direction of travel of the ampoules.

23. The ampoule sealing station of claim 21 in which the acute angle is about 30°.

24. The ampoule sealing station of claim 19 in which the manifold is provided with a central linear slot, said slot being between and parallel to the outer burner means.

25. A filled-ampoule loading station of an ampoule filling and sealing machine having surge accommodation comprising a channel to receive a line of sealed ampoules, one side of a portion of said channel being defined by a horizontal spring, a spring-loaded backing bar behind said horizontal spring, stop means spaced from said backing bar and mounted on a fixed support, at least two horizontal discharge trays at the outlet of said channel, means to alternately shift said trays so that one loaded tray may be removed and replaced with an empty tray while the other tray is being filled, spring-loaded gate means at the inlet to each tray for biasing filled ampoules toward the back of the tray, and a movable linear bar on each tray, each movable linear bar being substantially perpendicular to said channel.

26. An ampoule filling and sealing machine comprising an ampoule filling station having a walking beam purger-filler, means drivingly engaging one side of a line of empty ampoules to move said line continually below said purger-filler, means to slidably engage the other side of said line, said last-named means comprising a plurality of aligned rails, said rails being movably spring-loaded toward said line except foer the final rail, said final rail being stationary, means to intermittently positively engage ampoules below the purger-filler to synchronize them with said purger-filler, said last-named means shifting the ampoules engaged thereby away from the drivingly engaging means, and an ampoule sealing station having burner means, gripper finger means, means to move a line of filled ampoules through said ampoule sealing station, and means to rotate filled ampoules including means for urging filled ampoules downwardly to a pre-determined position during burner-sealing which comprises a line of spaced-apart inclined discs on one side of and in contact with a line of linearly moving filled ampoules, each of said inclined discs having a resilient periphery and a downstream inclination.

27. An ampoule filling and sealing machine with a first station to feed empty ampoules to the machine and a second station to load filled ampoules from the machine, said first station comprising an inclined tray to receive empty ampoules base down, a first belt having a horizontal reach below the lower edge of said tray, a second belt having a vertical reach above said horizontal reach, and means to move said reaches of said first and second belts horizontally toward the filling station, so that empty ampoules sliding downwardly on said inclined tray onto said first reach are moved towards the filling station by both of said reaches, said second station having surge accommodation and comprising a channel to receive a line of sealed ampoules, one side of a portion of said channel being defined by a horizontal spring, a spring-loaded backing bar behind said horizontal spring, stop means spaced from said backing bar and mounted on a fixed support, at least two horizontal discharge trays at the outlet of said channel, means to alternately shift said trays so that one loaded tray may be removed and replaced with an empty tray while the other tray is being filled, spring-loaded gate means at the inlet to each tray for biasing filled ampoules towards the back of the tray, and a movable linear bar on each tray, each movable linear bar being substantially perpendicular to said channel.

28. In an ampoule filling and sealing machine, an empty-ampoule feeding station and an apparatus for moving a line of ampoules from the feeding station successively through a filling station and a sealing station of said machine, comprising an inclined tray to receive empty ampoules base down, a belt having a horizontal reach below the lower edge of said tray, movable means having a vertical reach above said horizontal reach, and means to move the reach of said belt horizontally toward the filling station, so that empty ampoules sliding downwardly on said inclined tray onto said reach are moved toward the filling station by the reach of said belt and said movable means, said apparatus comprising a horizontally oriented endless drive chain trained about two horizontally opposed aligned vertically oriented sprockets, means to rotate at least one of said sprockets, a plurality of spaced apart cylindrical rollers mounted on said drive chain, the central axis of each of said rollers being vertical, an ampoule being receivable between each pair of adjacent rollers, and means to define a channel in conjunction with the rollers on a reach of the drive chain.

29. In an ampoule filling and sealing machine, an ampoule sealing station and an apparatus for moving a line of ampoules successively through a filling station and the sealing station of said machine, burner means in said ampoule sealing station comprising a plurality of juxtaposed individual substantially horizontal gas burners, said gas burners being aligned in parallel at an acute angle to the direction of travel of the ampoules, so that a flame is emitted from each gas burner with a component of motion in the direction of travel of the ampoules, said apparatus comprising a horizontally oriented endless drive chain trained about two horizontally opposed aligned vertically oriented sprockets, means to rotate at least one of said sprockets, a plurality of spaced apart cylindrical rollers mounted on said drive chain, the central axis of each of said rollers being vertical, an ampoule being receivable between each pair of adjacent rollers, means to define a channel in conjunction with the rollers on a reach of the drive chain, each of said rollers being provided with a functionally integral pinion, a first rack at the sealing station, said pinions being engageable with said first rack so that the ampoules are rotated as they move through the sealing station and means to facilitate engagement of said pinion with said first rack.

30. in an ampoule filling and sealing machine, an ampoule sealing station in which ampoules travel in two parallel lines past and between two parallel outer burner means, and an apparatus for moving the two lines of ampoules successively through a filling station and the sealing station of said machine, a central linear air curtain manifold in said ampoule sealing station, said manifold being between the two lines of ampoules and having at least one top opening, means to direct air into said manifold, so that a linear air curtain is provided between the two lines of ampoules, said apparatus comprising a horizontally oriented endless drive chain trained about two horizontally opposed aligned vertically oriented sprockets, means to rotate at least one of said sprockets, a plurality of spaced apart cylindrical rollers mounted on said drive chain, the central axis of each of said rollers being vertical, an ampoule being receivable between each pair of adjacent rollers, and means to define a channel in conjunction with the rollers on a reach of the drive chain.

* * * * *